US008573311B2

(12) United States Patent
Zhao et al.

(10) Patent No.: US 8,573,311 B2
(45) Date of Patent: Nov. 5, 2013

(54) PRESSURE PULSE-INITIATED FLOW RESTRICTOR BYPASS SYSTEM

(71) Applicant: Halliburton Energy Services, Inc., Houston, TX (US)

(72) Inventors: Liang Zhao, Carrollton, TX (US); Jean-Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/666,345

(22) Filed: Nov. 1, 2012

(65) Prior Publication Data

US 2013/0186639 A1 Jul. 25, 2013

(30) Foreign Application Priority Data

Jan. 20, 2012 (WO) ..... PCT/US2012/022040

(51) Int. Cl.
*E21B 34/08* (2006.01)

(52) U.S. Cl.
USPC ..... 166/373; 166/66.6; 166/386; 166/334.4

(58) Field of Classification Search
USPC ..... 166/373, 334.4, 386, 66.6, 66.7
See application file for complete search history.

(56) References Cited

U.S. PATENT DOCUMENTS

| | | | | |
|---|---|---|---|---|
| 6,622,794 | B2 * | 9/2003 | Zisk, Jr. | 166/373 |
| 7,044,229 | B2 * | 5/2006 | Tennoy et al. | 166/373 |
| 7,048,057 | B2 | 5/2006 | Bearden et al. | |
| 7,387,165 | B2 * | 6/2008 | Lopez de Cardenas et al. | 166/313 |
| 7,543,641 | B2 | 6/2009 | Contant | |
| 7,819,194 | B2 * | 10/2010 | Tips | 166/316 |
| 2003/0070809 | A1 | 4/2003 | Schultz et al. | |
| 2003/0111224 | A1 * | 6/2003 | Hailey et al. | 166/278 |
| 2009/0283322 | A1 * | 11/2009 | Dove | 175/40 |
| 2010/0175867 | A1 | 7/2010 | Wright et al. | |
| 2011/0043099 | A1 | 2/2011 | Duan et al. | |

FOREIGN PATENT DOCUMENTS

| | | | |
|---|---|---|---|
| EP | 0791290 | A2 | 8/1997 |
| WO | 2004048748 | A1 | 6/2004 |
| WO | 2008053364 | A2 | 5/2008 |

OTHER PUBLICATIONS

Specification and Drawings for U.S. Appl. No. 13/742,053, filed Jan. 15, 2013, 27 pages.
Search Report issued Sep. 25, 2012 for International Application serial No. PCTUS1222040, 5 pages.
Written Opinion issued Sep. 25, 2012 for International Application serial No. PCTUS1222040, 3 pages.
International Search Report with Written Opinion issued Sep. 25, 2012 for PCT Patent Application No. PCT/US12/022040, 8 pages.
International Search Report with Written Opinion issued Nov. 23, 2012 for PCT Patent Application No. PCT/US12/022043, 13 pages.

* cited by examiner

*Primary Examiner* — Giovanna Wright
(74) *Attorney, Agent, or Firm* — Smith IP Services, P.C.

(57) ABSTRACT

A method of variably restricting flow in a subterranean well can include resisting the flow through a sidewall of a tubular string, and then selectively opening a device in response to a predetermined pressure signal being transmitted. The opening of the device can substantially reduce a resistance to the flow through the tubular string sidewall. A flow restrictor system for use with a subterranean well can include a flow restrictor which resists flow through system, a pressure sensor, and an initially closed device which opens and thereby permits the flow to bypass the flow restrictor, in response to a predetermined pressure signal being detected by the sensor.

15 Claims, 5 Drawing Sheets

PRESSURE PULSE-INITIATED FLOW RESTRICTOR BYPASS SYSTEM

CROSS-REFERENCE TO RELATED APPLICATION

This application claims the benefit under 35 USC §119 of the filing date of International Application Serial No. PCT/US12/22040, filed 20 Jan. 2012. The entire disclosure of this prior application is incorporated herein by this reference.

BACKGROUND

This disclosure relates generally to equipment utilized and operations performed in conjunction with a subterranean well and, in one example described below, more particularly provides a flow restrictor bypass system which operates in response to remotely transmitted pressure pulses.

It is frequently desirable to restrict flow into a tubular string from one or more productive zones penetrated by a wellbore. However, it may become desirable at a future date to cease restricting flow into the tubular string, so that flow into the tubular string is relatively unrestricted.

For this reason and others, it will be appreciated that improvements are continually needed in the art of variably restricting flow in a subterranean well.

SUMMARY

In this disclosure, systems and methods are provided which bring improvements to the art of variably restricting flow in a subterranean well. One example is described below in which a bypass flow path around a flow restrictor is opened when it is desired to no longer restrict the flow (or to at least substantially decrease a restriction to the flow). Another example is described below in which the bypass flow path is opened after flow is initially restricted by the flow restrictor.

A method of variably restricting flow in a subterranean well is described below. In one example, the method can include resisting the flow through a sidewall of a tubular string, and then selectively opening a device in response to a predetermined pressure signal being transmitted. The opening of the device substantially reduces a resistance to the flow through the tubular string sidewall.

A flow restrictor system for use with a subterranean well is also described below. In one example, the system can include a flow restrictor which resists flow through the system, a pressure sensor, and an initially closed device which opens, and thereby permits the flow to bypass the flow restrictor, in response to a predetermined pressure signal being detected by the sensor.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
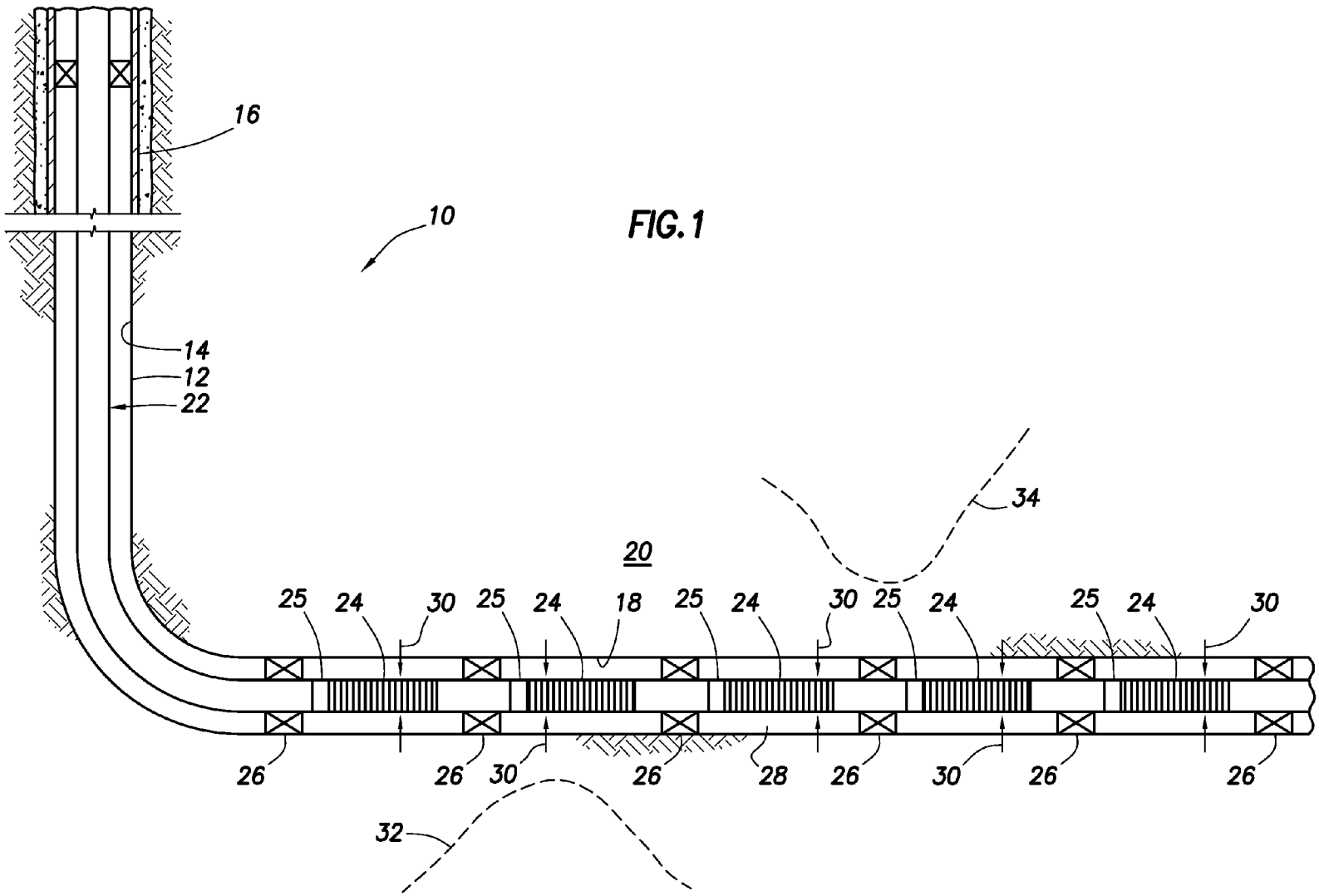
FIG. 1 is a representative partially cross-sectional view of a well system and associated method which can embody principles of this disclosure.

Representatively illustrated in FIG. 1 is a system 10 for use with a well, and an associated method, which can embody principles of this disclosure. As depicted in FIG. 1, a wellbore 12 in the system 10 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, variable flow restrictor systems 25 and packers 26.

The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a variable flow restrictor system 25 are interconnected in the tubular string 22. The well screen 24 filters the fluids 30 flowing into the tubular string 22 from the annulus 28. The variable flow restrictor system 25 initially restricts flow of the fluids 30 into the tubular string 22.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be injected into a formation, fluids could be both injected into and produced from a formation, etc.

It is not necessary for one each of the well screen 24 and variable flow restrictor system 25 to be positioned between each adjacent pair of the packers 26. It is not necessary for a single variable flow restrictor system 25 to be used in conjunction with a single well screen 24. Any number, arrangement and/or combination of these components may be used.

It is not necessary for any variable flow restrictor system 25 to be used with a well screen 24. For example, in injection operations, the injected fluid could be flowed through a variable flow restrictor system 25, without also flowing through a well screen 24.

It is not necessary for the well screens 24, variable flow restrictor systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the scope the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

Examples of the variable flow restrictor systems 25 described more fully below can provide these benefits by restricting flow (e.g., to thereby balance flow among zones, prevent water or gas coning, restrict flow of an undesired fluid such as water or gas in an oil producing well, etc.). However, when it is no longer desired to restrict the flow of the fluid 30, one or more parallel bypass flow paths can be opened, so that relatively unrestricted flow of the fluid into (or out of) the tubular string 22 is permitted.

Figure 2:
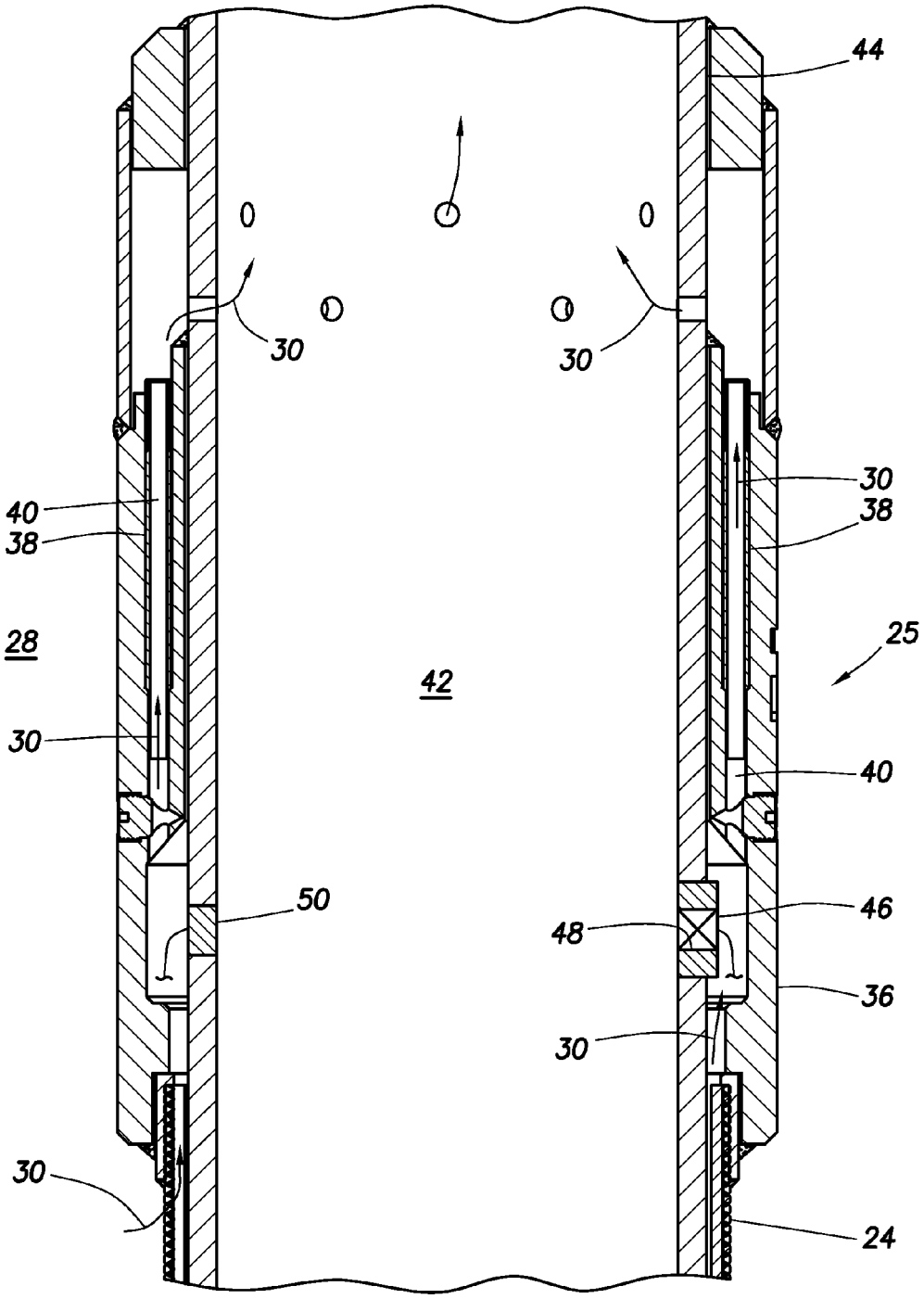
FIG. 2 is an enlarged scale representative cross-sectional view of a variable flow restrictor system which may be used in the well system and method of FIG. 1.

Referring additionally now to FIG. 2, an enlarged scale cross-sectional view of one example of the variable flow restrictor system 25 is representatively illustrated. In this example, the fluid 30 flows through the screen 24, and is thereby filtered, prior to flowing into a housing 36 of the system 25.

Secured in the housing 36 are one or more generally tubular flow restrictors 38 which restrict flow of the fluid 30 through the housing. Other types of flow restrictors (such as orifices, tortuous flow paths, vortex chambers, etc.) may be used, if desired. The scope of this disclosure is not limited to any particular type, number or combination of flow restrictors.

The flow restrictors 38 form sections of flow paths 40 extending between the annulus 28 on an exterior of the system 25 to an interior flow passage 42 extending longitudinally through a base pipe 44 of the screen 24 and system 25. The base pipe 44 can be configured for interconnection in the tubular string 22, in which case the flow passage 42 will extend longitudinally through the tubular string, as well.

An openable device 46 initially closes off an additional flow path 48 which is parallel to the flow paths 40. The flow paths 40, 48 are "parallel," in that they can each be used to conduct the fluid 30 from one place to another, but the fluid does not have to flow through one before it flows through the other (i.e., the flow paths are not in series).

In the FIG. 2 example, the device 46 is in the base pipe 44 within the housing 36. However, the scope of this disclosure is not limited to any particular location of the device 46.

Flow through the flow path 48 is prevented, until the device 46 is opened. Any technique for opening the flow path 48 may be used (e.g., opening a valve, combusting a material, mixing multiple materials, etc.). Several ways of opening the flow path 48 are described below, but it should be clearly understood that the scope of this disclosure is not limited to any particular way of opening the flow path.

When the flow path 48 is opened, the fluid 30 can flow relatively unrestricted from the screen 24, through the flow paths, and into the passage 42. Thus, flow between the interior and the exterior of the system 25 is not restricted substantially by the flow restrictors 38, although since the flow restrictors are in parallel with the flow paths 48, there will be some flow through the restrictors. However, this flow through the restrictors 38 will be minimal after the device 46 is opened, because the fluid 30 will tend to flow more through the less restrictive flow path 48 (e.g., the path of least resistance).

In the FIG. 2 example, the flow path 48 is formed through a wall of the base pipe 44. However, other locations for the flow path 48 may be used, if desired.

The device 46 can comprise a valve. An electrically operated valve, such as any of the valves described in U.S. Publication No. 2010/0175867 (the entire disclosure of which is incorporated herein by this reference), may be used if desired.

The system 25 also includes a pressure sensor 50. In FIG. 2, the sensor 50 is positioned so that it can detect pressure in the passage 42. In this manner, a predetermined pressure signal can be transmitted via the passage 42 to the system 25 from a remote location (such as the earth's surface, a subsea facility or another location in the well, etc.). In other examples, the sensor 50 could be positioned to detect pressure in the annulus 28 or another downhole region.

In one example, the pressure signal can comprise multiple pressure pulses having a predetermined level, duration, number, frequency, amplitude, phase, spacing, etc. Any type of pressure pulses may be used, as desired.

When the predetermined pressure signal is detected by the sensor 50, the device 46 opens, thereby permitting flow of the fluid 30 through the flow path 48, bypassing the flow restrictors 38. As discussed above, this substantially reduces the restriction to flow of the fluid 30 between the interior and exterior of the tubular string 22.

A control module (not shown) including, for example, a programmable processor, memory, an electrical power supply (such as batteries, a downhole generator, etc.) can be provided in the system 25. The control module can receive measurements from the sensor 50 and, when the sensor detects the predetermined pressure signal (e.g., the measurements by the sensor match a predetermined pattern stored in the control module memory, etc.), the processor can cause the device 46 to be actuated (e.g., by closing a switch which thereby connects electrical power to the device, etc.).

Note that the control module may not be used in other examples. For example, the device 46 could be actuated in response to a predetermined pressure signal (e.g., having a certain amplitude, duration, frequency, etc.), without use of a separate control module.

Figure 3:
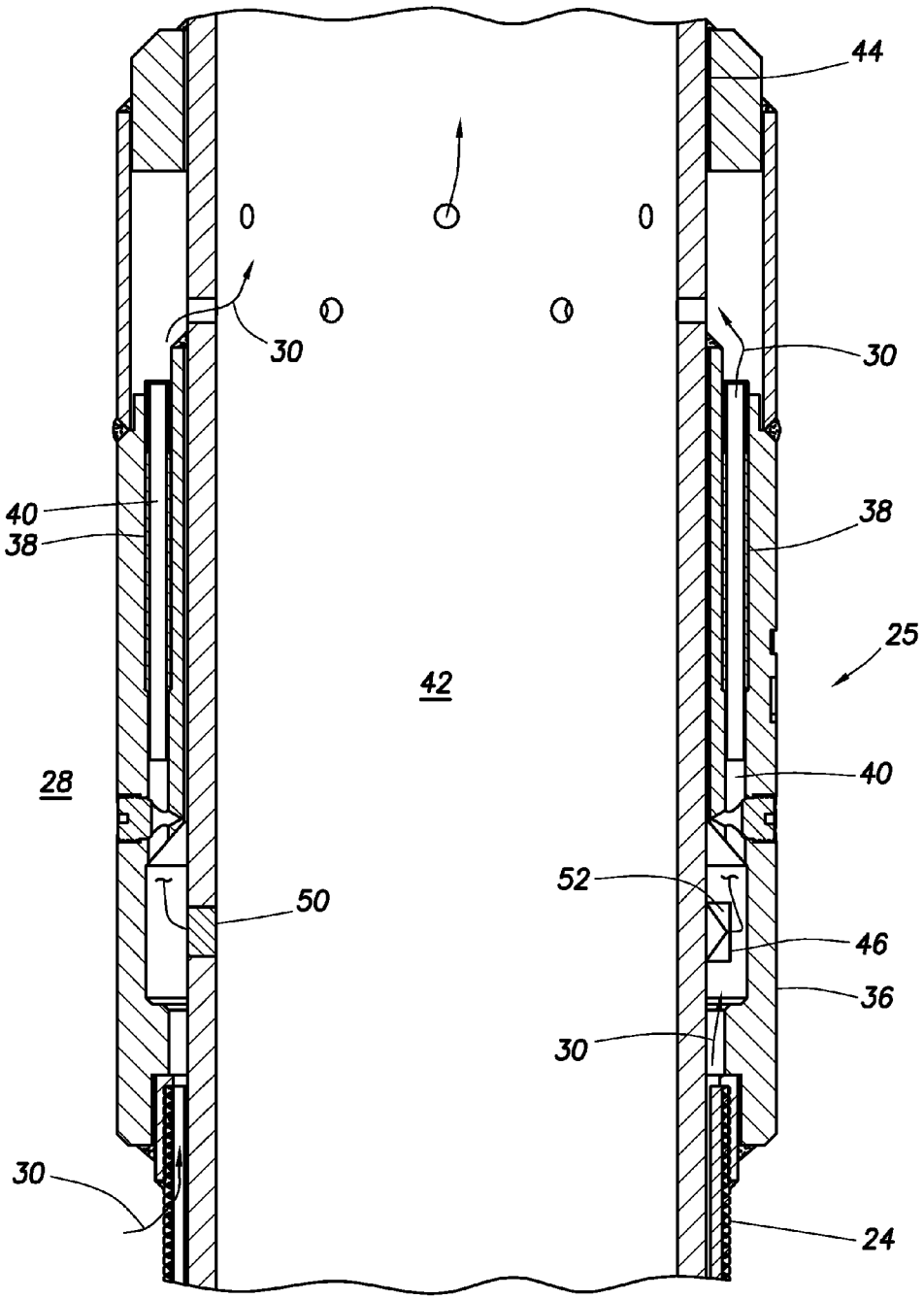
FIG. 3 is a representative cross-sectional view of another example of the variable flow restrictor system.

In FIG. 3, another example of the system 25 is representatively illustrated, in which the device 46 comprises a perforating charge which perforates the base pipe 44 to form the flow path 48 when the pressure signal is detected by the sensor 50. Thus, the bypass flow path 48 does not exist until the device 46 is detonated.

The perforating charge includes a combustible material 52 (such as an explosive, e.g., HMX, HNS, RDX, etc.) which, when detonated, forms the flow path 48 through the base pipe 44. As another example, the material 52 could comprise thermite, which produces substantial heat when ignited, whereby the heat forms the flow path 48 through the base pipe 44.

Figure 4:
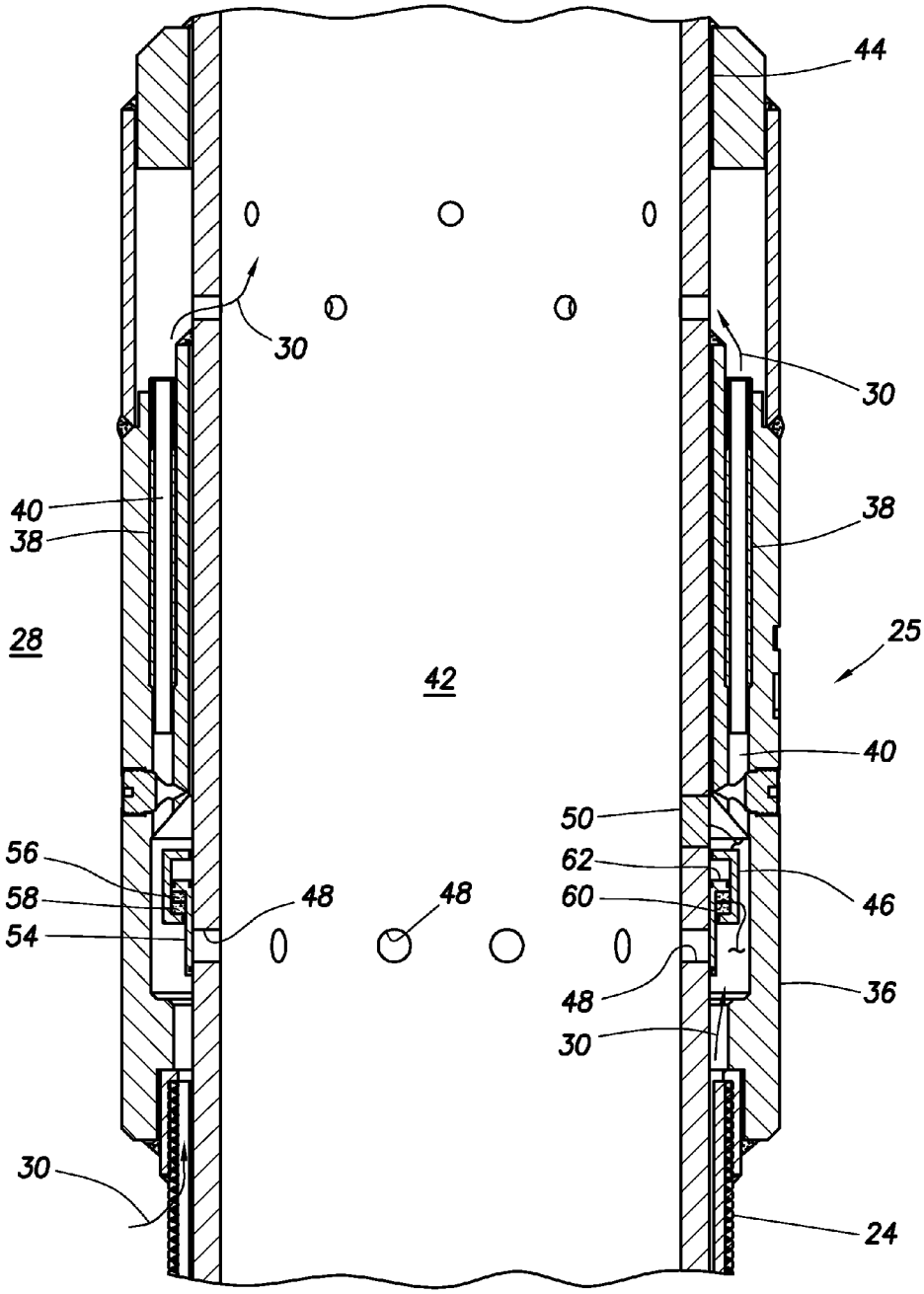
FIG. 4 is a representative cross-sectional view of another example of the variable flow restrictor system.

In FIG. 4, another example of the system 25 is representatively illustrated. In this example, the device 46 comprises a valve with a sleeve 54 which initially blocks flow through multiple flow paths 48.

The device 46 also includes reactant materials 56, 58 initially separated by a barrier 60. When the predetermined pressure signal is detected by the sensor 50, the barrier 60 is compromised, thereby allowing the materials 56, 58 to contact each other.

Such contact between the materials 56, 58 increases a pressure differential across a piston 62 of the device 46, causing the sleeve 54 to displace upward (as viewed in FIG. 4), thereby opening the flow paths 48. The materials 56, 58 can comprise any materials which, when contacted with each other, increase pressure or temperature in the device 46.

Figure 5:
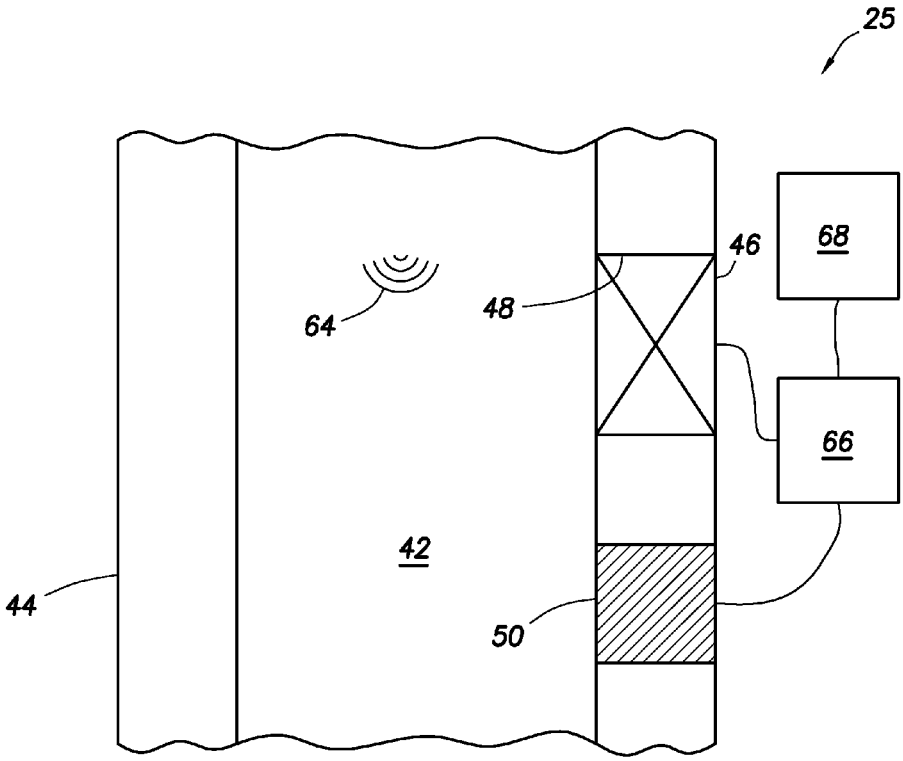
FIG. 5 is a representative cross-sectional view of another example of the variable flow restrictor system.

In FIG. 5, a portion of the system 25 is representatively illustrated, in which the device 46 is in the form of a valve which opens when a predetermined pressure signal 60 (e.g., a series of predetermined pressure pulses, etc.) is detected by the pressure sensor 50. The sensor 50 is connected to a controller 66, which is supplied with electrical power from a power supply 68 (for example, batteries, a downhole generator, etc.). The controller 66 causes the valve device 46 to actuate open, in response to the signal 64 being detected by the sensor 50.

Suitable valves for use in the system 25 of FIG. 5 are described in U.S. Publication No. 2010/0175867, mentioned above. Any type of valve may be used for the device 46 in the system 25, as desired.

The controller 66 and power supply 68 may be used for actuation of the device 46 in any of the other examples of the system 25 described above. However, other means of controlling operation of the device 46 may be used, in keeping with the principles of this disclosure.

It may now be fully appreciated that the above disclosure provides significant advancements to the art of variably restricting flow in a well. The system 25 described above allows for conveniently changing the resistance to flow through the system (e.g., between the interior and exterior of the system). In examples described above, this change can be made without intervening into the well, e.g., by transmitting the pressure signal 64 from a remote location.

A method of variably restricting flow in a subterranean well is described above. In one example, the method can include resisting the flow through a sidewall of a tubular string 22, and then selectively opening a device 46 in response to a predetermined pressure signal 64 being transmitted. The opening of the device 46 substantially reduces a resistance to the flow through the tubular string 22 sidewall.

The flow can substantially bypass a flow restrictor 38 in response to the opening of the device 46.

The method can also include a pressure sensor 50 detecting the pressure signal 64.

The device 46 may comprise a valve, a perforating charge, a combustible material, and/or multiple materials which increase pressure in the device in response to contacting the materials with each other.

The flow may be between an interior and an exterior of the tubular string 22 in the well. The flow can be from a screen 24 to an interior of the tubular string 22. The device 46 may receive fluid 30 from the screen 24.

The pressure signal 64 can comprise multiple pressure pulses.

A flow restrictor system 25 for use with a subterranean well is also described above. In one example, the system 25 can include a flow restrictor 38 which resists flow through the system 25, a pressure sensor 50, and an initially closed device 46 which opens and thereby permits the flow to bypass the flow restrictor 38, in response to a predetermined pressure signal 64 being detected by the sensor 50.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A flow restrictor system for use with a subterranean well, the system comprising:

a flow restrictor which resists flow through the system;

a pressure sensor; and an initially closed device which opens and thereby permits the flow to bypass the flow restrictor, in response to a predetermined pressure signal being detected by the sensor, wherein the device comprises multiple materials which increase pressure in the device in response to contact of the materials with each other.

2. The system of claim 1, wherein the pressure signal comprises multiple pressure pulses.

3. The system of claim 1, wherein the flow restrictor permits the flow through the system.

4. The system of claim 1, wherein the flow is between an interior and an exterior of a tubular string in the well.

5. The system of claim 1, wherein the device comprises a valve.

6. The system of claim 1, wherein the flow restrictor receives fluid from a screen.

7. The system of claim 6, wherein the device receives the fluid from the screen.

8. A method of variably restricting flow in a subterranean well, the method comprising:

resisting the flow through a sidewall of a tubular string; and then selectively opening a device in response to a predetermined pressure signal being transmitted, the opening of the device substantially reducing a resistance to the flow through the tubular string sidewall, wherein the device comprises multiple materials which increase pressure in the device in response to contacting the materials with each other.

9. The method of claim 8, wherein the flow substantially bypasses a flow restrictor in response to the opening of the device.

10. The method of claim 8, further comprising a pressure sensor detecting the pressure signal.

11. The method of claim 8, wherein the device comprises a valve.

12. The method of claim 8, wherein the flow is between an interior and an exterior of the tubular string in the well.

13. The method of claim 8, wherein the flow is from a screen to an interior of the tubular string.

14. The method of claim 13, wherein the device receives fluid from the screen.

15. The method of claim 8, wherein the pressure signal comprises multiple pressure pulses.

* * * * *